United States Patent [19]

Fickers

[11] 4,315,049

[45] Feb. 9, 1982

[54] STITCHLESS LOW BULK, PIN-TYPE SEAM FOR USE IN PAPER MAKING EQUIPMENT FABRICS, SUCH AS DRYER FELTS

[75] Inventor: Gisela Fickers, Eupen, Belgium

[73] Assignee: Asten Group, Incorporated, Devon, Pa.

[21] Appl. No.: 144,444

[22] Filed: Apr. 28, 1980

Related U.S. Application Data

[63] Continuation-in-part of Ser. No. 100,946, Dec. 6, 1979.

[51] Int. Cl.[3] ..... D21F 7/10; D03D 25/00

[52] U.S. Cl. ..... 428/104; 139/383 A; 245/10; 24/38; 428/130; 428/223

[58] Field of Search ..... 139/383 A, 383 AA; 245/10; 24/140, 145, 38, 31; 112/400, 441; 428/104, 130, 223; 162/DIG. 1

[56] References Cited

U.S. PATENT DOCUMENTS

| | | | |
|---|---|---|---|
| 2,158,007 | 5/1939 | Ellis et al. | 24/31 |
| 3,281,905 | 11/1966 | Wagner | 112/400 |
| 3,900,659 | 8/1975 | MacBean | 428/223 |
| 4,026,331 | 5/1977 | Lees et al. | 139/383 A |
| 4,095,622 | 1/1978 | MacBean | 139/383 A |
| 4,123,022 | 10/1978 | Dutt et al. | 245/10 |
| 4,206,787 | 6/1980 | Strandly | 139/383 AA |
| 4,244,084 | 1/1981 | Gisbourne | 139/383 AA |
| 4,267,226 | 5/1981 | Kohler et al. | 24/38 |

*Primary Examiner*—Henry Jaudon

*Attorney, Agent, or Firm*—Benasutti Associates, Ltd.

[57] ABSTRACT

A novel low bulk seam is disclosed for use in paper making machine fabrics, such as dryer felts. The seam is particularly adapted for use with multi-filament yarns which comprise multi-ply fabrics. A novel method for producing this seam is disclosed which comprises the insertion and adhesion of a seaming coil, the removal of picks in adjacent fabric areas, the folding and overlapping of such areas, the creation of a warp fringe, and the pulling of portions of that fringe into and through portions of the fabric body fasteners to create a stitchless seam providing substantially uniform thickness and air permeability across the full fabric width. A durable, reliable, non-marking seam is accordingly provided for use with spun, mono-filament and/or multi-filament fabrics.

22 Claims, 8 Drawing Figures

STITCHLESS LOW BULK, PIN-TYPE SEAM FOR USE IN PAPER MAKING EQUIPMENT FABRICS, SUCH AS DRYER FELTS

CROSS-REFERENCE TO RELATED APPLICATIONS

The present application is a continuation-in-part of my prior co-pending patent application Ser. No. 100,946, filed Dec. 6, 1979 entitled, "Low Bulk, Pin-Type Seam For Use In Paper Making Equipment Fabrics, Such As Dryer Felts," which application is specifically incorporated by reference as if fully set forth herein.

BACKGROUND OF THE INVENTION

The present invention relates to the field of paper machine clothing, and more particularly to clothing for use in the dryer sections of such machines. The dryer section of a paper making machine is that portion of the machine wherein a wet paper web is dried down to about 6% water on large cast iron, steam-heated cylinders. These large smooth cylinders dry the web into a flat sheet. A dryer felt/fabric is needed to hold the wet web in intimate contact with the smooth dryers, otherwise wrinkles and cockles may develop in the sheet. If the sheet is not flat, serious difficulties may develop in the printing process. As paper machines have developed, dryer felts approaching 400 inches in width have come into use. Venting pockets in the dryers intended to purge excessive hot, moist air have also been developed which require new, extremely permeable dryer felt designs. Additionally, over the years the speed of operation of such dryer felts has increased, and is now approaching the four to five thousand feet per minute range. Since dryer felts are formed in the shape of long belts which are threaded around various guides, cylinders and rollers in almost all paper making machines, it is necessary to provide a seam in the felt at which the two ends, known as lap and hook ends, may be joined after the felt has been threaded. Due to the high speed, pressure, moisture, heat and other conditions of operation to which these dryer felts are subjected, the seam and the fabric in the immediate vicinity of the seam are subjected to extreme wear conditions. Additionally, substantially increased thickness in overlapped fabric ends can result in marking and/or other irregularities in the paper product to be dried.

In recent years, monofilament dryer fabrics have been developed which utilize "pin" seams wherein alternate monofilament warp ends are caused to form a "loop" at the end of the fabric and are woven back into the body of the fabric. The loops thus formed at the end of a monofilament fabric mate with complemental loops formed in the other end of that fabric so that a long wire or "pin" (pintel) may be inserted through the channel formed therebetween to join the two fabric ends. A seam thus formed in a monofilament fabric is not substantially thicker than the normal fabric thickness.

In recent years, various coil-type seams have also been developed wherein coils or spirals are inserted along a fold line. The fabric is folded back over itself and sewn or otherwise attached to itself to retain the coil and mateably receive a coil similarly attached to the other end of the dryer felt/fabric. A pin or wire may then be used to join the seam. To date, attempts to create a true "pin" type seam in multi-filament fabrics have been unsuccessful due to a lack of stability of the geometric configuration of loops formed from multi-filament (and even some monofilament) warp yarns of such fabric. While coil seams have achieved some success in the field of paper machine clothing, the additional thickness and thickness irregularity attendant with such seams has limited their applicability, life and/or reliability.

Various materials have been suggested for use in making coil-type seams. For example, spirals of polyester monofilament have been suggested which are manufactured by taking extruded polyester monofilament yarn, wrapping it around a mandrel, and heat setting it to cause it to take a spiral shape. It is also known to create spirals of multi-filament material, particularly materials which is capable of being heat set in a similar manner. For example, it is known to create a spiral or coil for insertion into a coil-type seam by taking a nylon monofilament and using a conventional braiding machine to braid around that monofilament with polyester and aramide threads. The resulting braided coil may be wound on a mandrel and heat set. As used hereinafter in this application, the term "coil material" shall refer to any of the spirals or coils heretofore known to the art, but preferably to the braided multi-filament coil described above.

SUMMARY OF THE INVENTION

The present invention provides a novel method for producing a stitchless "pin-type" coil seam in fabric to be used for clothing paper making equipment. This seam is produced by performing various sequential steps of removing pick yarns from the fabric in the vicinity of a seam fold line. Pick yarns are first removed to facilitate the insertion of a spiral coil, after which preselected numbers of pick yarns on either side of the coil are removed so that upon a subsequent fold over operation, a reduced fabric bulk in the vicinity of the fabric end (seam half) is created. Additional pick yarns are removed from the overlapping fabric end to create a warp yarn fringe which is then pulled back through the interior of a preselected portion of the fabric body so that the overlapping fabric end is adequately anchored. The slight additional bulk which is created in the fabric in the vicinity of the seam undergoes a relatively smooth transition with respect to the normal thickness of the fabric body. The novel low bulk seam of the present invention is useful with fabrics made with spun, mono-filament and multi-filament yarns.

The novel low bulk seam of the present invention is particularly adapted for use with fabrics made with multi-filament yarns, and more particularly, multi-filament warp yarns. In accordance with the preferred method of the present invention, a seaming coil is firmly and uniformly anchored with respect to the fabric end by threading a portion of the seaming coil back into itself to overlap a bolt thread, by using an adhesive application, and by subsequent resin treating. In this manner the desired geometric configuration of the coil is stabilized so that the fabric ends may easily be joined during installation of the paper clothing.

Accordingly, a primary object of the present invention is the provision of a novel stitchless, coil-type low bulk seam for use particularly with multi-ply, multi-filament paper machine clothing fabrics.

This, and other objects of the present invention will become apparent from the following more detailed description.

DETAILED DESCRIPTION OF THE PREFERRED EMBODIMENT

Figure 1:
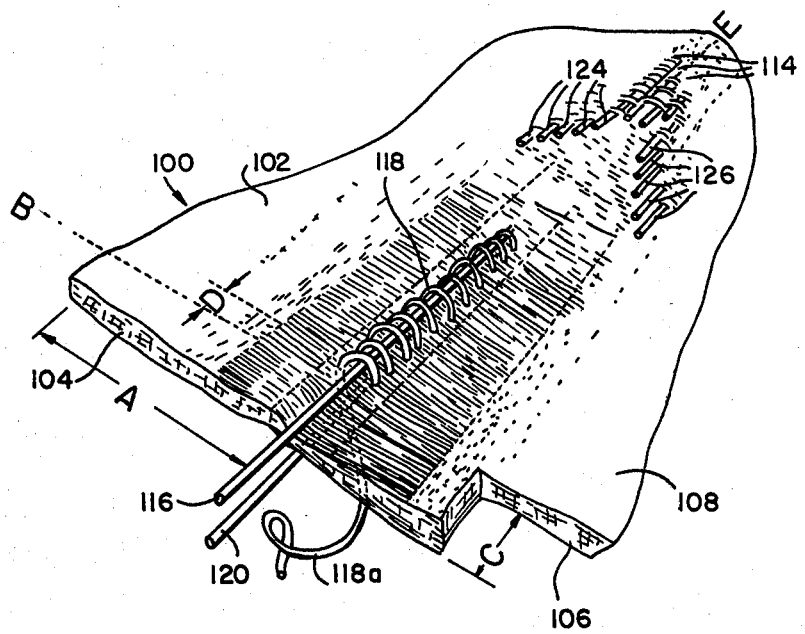
FIG. 1 is a diagrammatic, perspective, fragmentary view of a portion of an end of a two-ply fabric illustrating the steps of removing pick yarns to create apertures for a seaming coil, insertion of that seaming coil, and removal of additional pick yarns from the back ply of said fabric in regions adjacent to said coil. The figure further illustrates a portion of the width of that fabric being trimmed to size.

Although specific forms of the invention have been selected for illustration in the drawings, and the following description is drawn in specific terms for the purpose of describing these forms of the invention, this description is not intended to limit the scope of the invention which is defined in the appended claims.

The novel seam of the present invention is constructed from multi-ply fabrics, particular multi-ply fabrics containing multi-filament warp yarns, as described more fully hereinafter. As used in this application, the term "multi-filament yarns" is intended to include spun yarns. In the paper machine clothing industry, dryer felts are often produced having two or three plies, that is, two to three distinct layers of pick or filler yarns. It is within the scope of the present invention, however, to utilize the disclosed methods with fabrics having more than three-plies, if desired. Additionally, while the present invention is described in connection with multiple ply fabrics comprising multi-filament yarns, it is anticipated that either the warp or pick yarns or both of the fabric may be mono-filament yarns and spun or staple yarns.

Referring now to the drawings, and particularly to FIGS. 1–4, a fragmentary portion of the corner of a two-ply fabric is disclosed to illustrate various stages of seam formation. In FIG. 1, the fabric end designated generally 100 is seen to comprise a terminal edge 102, a side edge 104 and a trimmed edge 106. The back surface 108 of the fabric designated generally 100, faces upwardly, that is, towards the viewer. In accordance with the preferred embodiment method of the present invention, a length of fabric to be seamed is provided comprising a plurality of longitudinal warp yarns interwoven with a plurality of ply forming layers of transverse pick yarns, said layers defining at least front and back plies. The location of such plies is particularly well illustrated in FIGS. 3 and 4 of these drawings, wherein it will be noted that the ends 110 of the transverse pick yarns of the face layer and 112 of the back layer are readily visible.

The fabric to be seamed is selected to be of a preselected length "A" longer than the desired fabric length upon completion of the seam half. Typically, "A" ranges between 5 and 9 inches, preferably 6 to 8 inches. Additionally, the fabric, designated generally 100, should be selected to be somewhat wider than the finished width, so that a final seam and fabric edge as represented by dotted line "B" may be established by trimming off a width such as width "C," of the fabric. This seam offset distance "C" is preferably between $\frac{1}{2}$ inch and 3 inches, and more preferably is between 1 to 2 inches. Finally, a seam edge margin "D" as illustrated in FIG. 1, is maintained which represents the margin between the end of the seaming coil and the trimmed edge "B" of the fabric.

The next step in the construction of the seam half involves removing, at a preselected fabric position, a preselected number of pick yarns to create apertures therein which define a fold line which corresponds to the fabric terminus of one of the sides of the seam to be formed. This fold line axis is illustrated in FIG. 1 by broken line "E." The apertures thus formed by the removal of a preselected number of pick yarns will be disposed to receive the insertion of a seaming coil, said fold line defining adjacent fabric body and fabric overlap regions on said fabric. In the preferred embodiment for a two-ply construction, 3 face and 3 back picks are removed from the fabric, which picks are seen to be cut furthest back in FIG. 1, and which have been designated generally 114.

The next step in the seam producing method is the insertion of a seam coil, designated generally 118, by threading said coil through said apertures, and by retaining said coil by simultaneously threading a bolt thread designated generally 116 between the coil and the back surface of the fabric. In the preferred embodiment, the coils are of the braided type described above. For ease of final seam installation, blue colored coils may be installed on the lap (leading) end, and orange colored coils may be installed on the hook (trailing) end of the seam. In order to insure that the leading and trailing ends of the seam will mateably engage each other, it may be desired before installing coils to place both ends of the fabric together with the fold over sections back, at which point marks may be made to mark the first and last hooks of the comb or coil to be formed in the fabric across the width of the fabric. This procedure will insure that the proper number of coils will be installed within the same distance on each end of the fabric.

In addition to the bolt thread, designated generally 116, it is preferred to additionally install a rigid wire designated generally 120 which is threaded through the coils on the face side of the seam. Between the bolt thread 116 and rigid wire 120, no coils will be lost during the removal of a conventional coil installer which may be utilized to accomplish this step. In the preferred embodiment, 0.072 inch OD forming wire may be utilized or (less preferably) 0.054 inch OD music wire may be used as wire 120.

The next step in producing the desired seam comprises the step of removing preselected pick yarns from the back ply of the fabric in the fabric body and fabric overlap regions adjacent said coil. While the precise number of back picks to be removed may be varied somewhat, it is preferable at this step to remove about the same number of back picks from the body fabric region as from the overlap region of the fabric. Since the removal of a preselected number of picks from the fabric body region will establish the distance between the coil and the "tie down" line of the overlap region through weave-back, in this stitchless seam relatively fewer back picks are removed from the fabric body region than are removed when a stitched seam is constructed in accordance with the disclosure of my prior patent application Ser. No. 100,946, filed Dec. 6, 1979, referred to above. In accordance with the preferred embodiment of the present invention, sufficient back picks are permitted to remain in the regions immediately adjacent to the coil so that adequate dimensional stability is created in the seaming coil by reason of the presence of a preselected number of overlapping region front picks, and the proximity of the "tie down" line to the axis of coil attachment. Accordingly, for the two-ply embodiment 1 to 8, preferably 5, back picks are removed from the fabric overlap and fabric body regions at this stage of the seaming process. For the preferred stitchless two-ply seam shown in FIG. 1, five picks 124 are shown cut away in the overlap region of the fabric, and five picks 126 are illustrated cut away from the fabric body region. It is to be understood that while picks 114, 124 and 126 are illustrated only as being partially removed, in the performance of the method of the present invention, at appropriate process steps, the entirety of these picks across the width of the fabric will be removed; the insertion of the coil 118 will continue across the full width of the fabric rather than terminating in the position part way across the fabric as shown in FIG. 1. The method used for removing these picks may be any of those methods commonly utilized in the art for removing individual yarns from a woven fabric, and may comprise the utilization of a pick out needle or scribing tool for this purpose.

Figure 2:
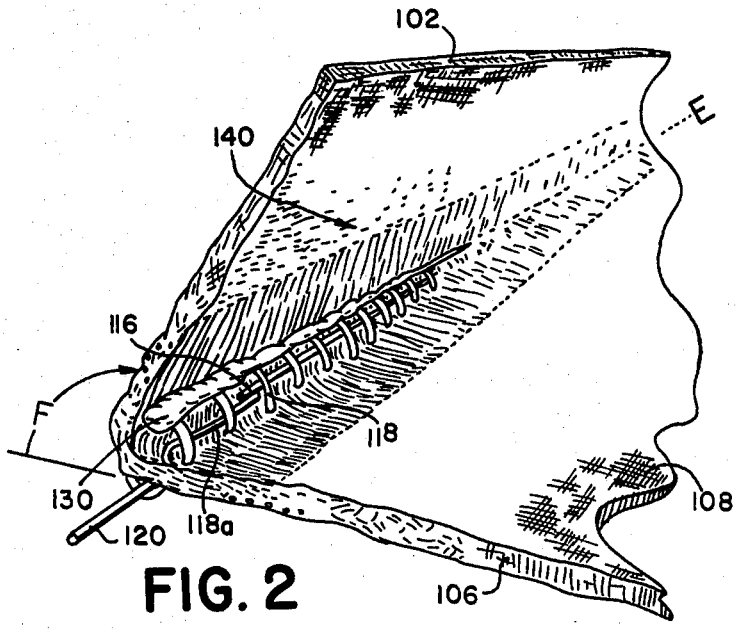
FIG. 2 is a perspective, diagrammatic, fragmentary view of the fabric end illustrated in FIG. 1, illustrating the fold over step which is performed following the application of adhesive.
Figure 3:
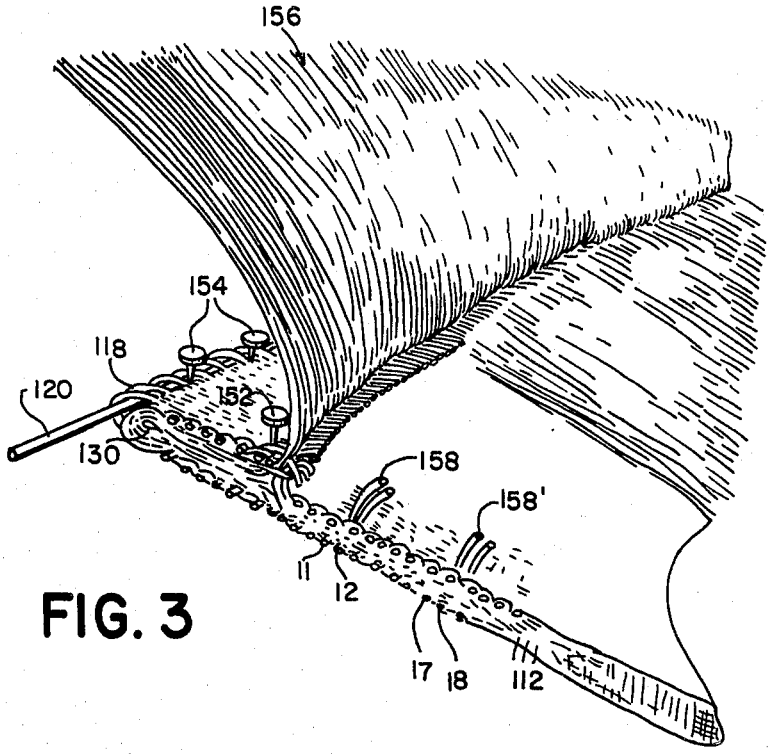
FIG. 3 is a diagrammatic, perspective, fragmentary view of the fabric end illustrated in FIGS. 1 and 2, illustrating the steps of temporary tacking of the work piece to a work surface, the creation of a warp fringe, and the pull through of several warp fringe yarns.
Figure 4:
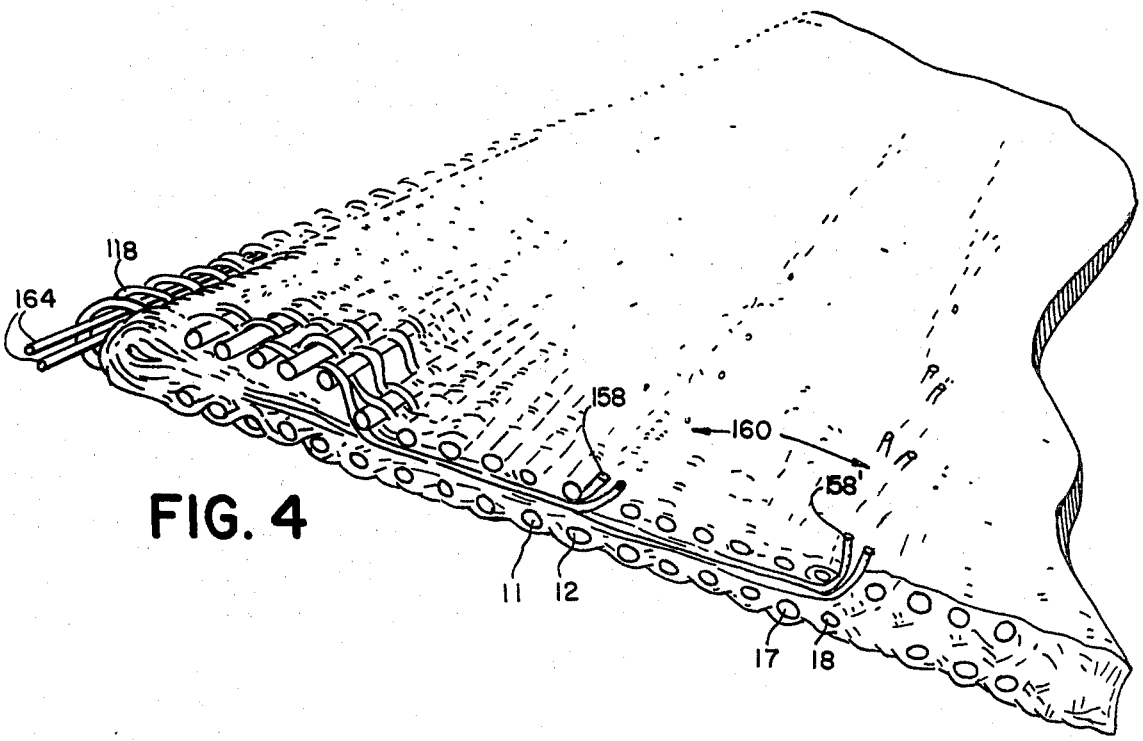
FIG. 4 is a perspective, diagrammatic, fragmentary view of the finished fabric seam illustrated in FIGS. 1–3, which fabric end mates with a complementally constructed fabric end to receive a "pin" or seaming wire, such as the wires shown in FIG. 4, to comprise the stitchless seam of the present invention.

Referring now in particular to FIG. 2, the end 118*a* of the coil will be finished by making sure that the coils do not extend any closer to the finished fabric edge "B" than the preselected edge margin "D," which in the preferred embodiment is at least $\frac{1}{8}$ of an inch, no more than $\frac{3}{8}$ of an inch, and preferably about $\frac{1}{4}$ of an inch. The excess amount or end 118*a* of the coil is then tucked back through itself to substitute near the end of the coil for the bolt thread, and is caused to overlap the bolt thread by a short distance. In the preferred embodiment, the excess amount of coil material tucked back into the seam edge is between 1 to 2 inches, preferably $1\frac{1}{2}$ inches, and the coil material is caused to overlap the bolt thread by about $\frac{1}{4}$ inch. If desired, at this point, the lap end and hook end of the seam may be temporarily matched to determine whether any problems or errors in the seam forming operation can be detected. If the leading and trailing ends match, a bead of glue 130 may now be applied over the bolt thread for the length of the seam. In the preferred embodiment, a satisfactory glue or adhesive is Minnesota Mining and Manufacturing Company, Scotch Adhesive No. 1099. After waiting a sufficient amount of time to permit some drying, approximately two to five minutes, the fabric overlap region on the fabric may be folded along the fold line "E" through the arc "F" indicated in FIG. 2, making sure to align the warps and picks correctly during the fold over process. The overlap region of the fabric may be properly aligned and retained with respect to the fabric body by using hand applied staples preferably every two-three inches and located between the second and third picks.

At this point, the fabric face may be fastened down to the front edge of a working table using tacks such as tacks 152 installed between the fifth and sixth picks at periodic locations of 5 to 6 inches across the entire width of the fabric. It has been found that the fabric is best positioned so that the seventeenth pick of the fabric is lined up with the front edge of the work table. It is also desirable to install tacks in the coil area, such as tacks 154 at longitudinal positions corresponding to tacks 152. It may be convenient to position the fabric so that the fifteenth pick of the fabric is lined up with the front edge of the work table. It will be possible to more easily ravel out the filling yarns in the overlap region of the fabric creating fringe designated generally 156.

The next step of the process is the step of drawing at least portions of the warp yarn fringe between yarns in said fabric body region to complete the first half of said coil seam. This is accomplished by using a crochet needle or other similar tool which is pushed between the layers of fabric, preferably under the sixth, seventh, eighth, ninth, tenth, (and eleventh) picks, grabbing the adjacent face, plain weave and 1–3 warp yarns and pulling them simultaneously through and out of the fabric between the tenth and eleventh picks. This process is shown beginning in FIG. 3. The back 1–3 warp yarns 158 are shown protruding from the back of the fabric between the tenth and eleventh picks. The crochet or weaving needle is then pushed between the layers of fabric under the sixth, seventh, eighth, ninth, tenth, eleventh, twelfth, thirteenth, fourteenth, and fifteenth picks grabbing the adjacent face plain weave on 1–3 warp yarns and pulling them simultaneously through and out of the fabric between the seventeenth and eighteenth picks. The alternating procedures are to be repeated across the entire width of the seam, after which all loose warp yarns such as warp yarns 158 and 158' protruding from the back of the fabric should be cut off as close as possible to the back surface of the fabric as shown particularly along the cut off line 160 shown in FIG. 4. The weave back lines 160 accordingly comprise trimmed 1–3 and 1–1 warp yarns.

Whether performed simultaneously or performed sequentially, each of the above steps which have been described with respect either to the lap or hook ends of the fabric should be repeated with respect to the complemental end of the fabric not yet processed in order to form mating seam halves. In this manner, the lap and hook ends of the seam may be mateably interposed to define a pin receiving channel suitable for the reception of a seam-joining pin or wire.

Having completed the mechanical construction of the seam, the seam and fabric are now ready for finishing, which is preferably accomplished using a resin treatment. The fabric may joined with two suitably sized synthetic pintels. It is preferred that the fabric to be used will have been heat set prior to the beginning of the seam construction method. At this point, if puckers appear in the seam area on applying fabric treatment tension, these can be removed with the application of a local heat through the use of a hot air blower. If no puckers appear, edge cutting and sealing procedures of a conventional type may be performed and the fabric resin treated. A $\frac{1}{4}$ inch wide bead of epoxy resin should preferably be applied at the edges and ends of the seam down the seam edge for $\frac{1}{2}$ inch on the face and back of the seam. If desired, additional epoxy resin may be applied after the coils in $\frac{1}{4}$ inch wide beads, skipping $\frac{3}{4}$ of an inch to 1 inch between applications. Preferably, polyurethane resin may then be applied to the coil loops, which step can be completed while the epoxy resin is drying and curing. In order to complete the finished seam, two suitably sized joining wire assemblies 164 are preferred for final assembly of the seam.

In accordance with the preferred method of the present invention, three-ply fabrics may also be utilized in producing the low bulk seam of the present invention. The method of producing such a seam is illustrated in FIGS. 5–8, which figures generally correspond to FIGS. 1–4 described above with respect to a two-ply fabric. These figures have had their components numbered in the "200 series," each component so numbered being 100 greater than the corresponding component identified in FIGS. 1–4 with respect to two-ply fabrics. Except as discussed hereinbelow, the preferred method of producing a seam in three-ply fabric is identical to the method used in producing such a seam in two-ply fabric, as described above.

Figure 5:
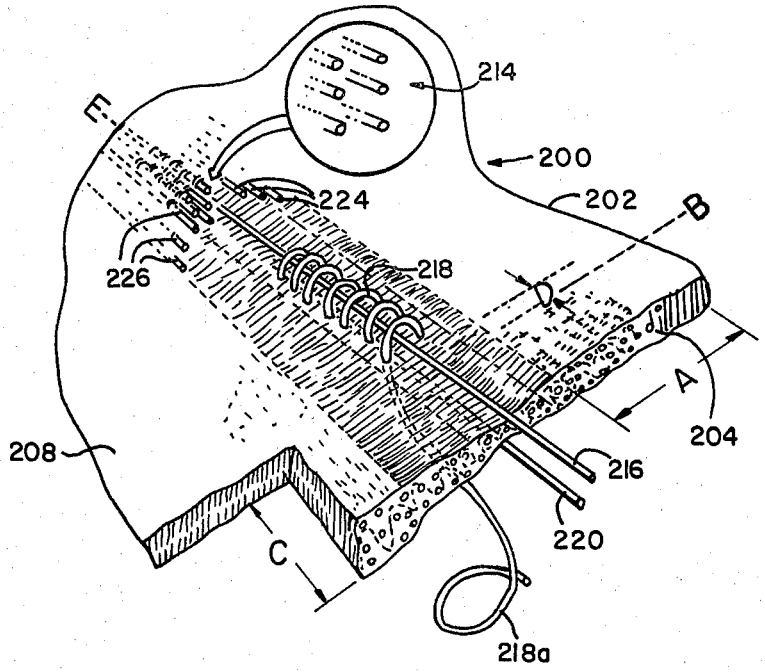
FIG. 5 is a diagrammatic, perspective, fragmentary view of a fabric end of three-ply fabric illustrating similar steps as those illustrated for the two-ply fabric end illustrated in FIG. 1, a blown up portion of the three-ply fabric being provided for purposes of clarity.
Figure 6:
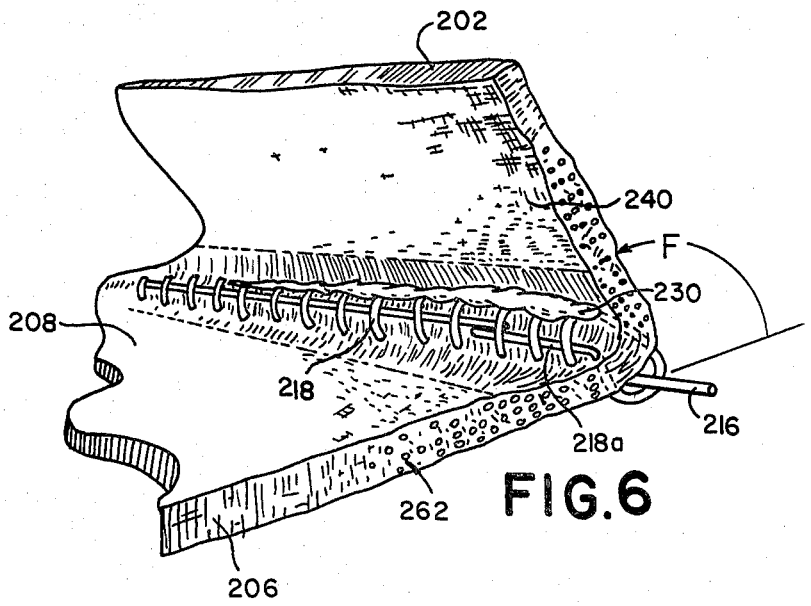
FIG. 6 is a diagrammatic, perspective, fragmentary view of the three-ply fabric end illustrated in FIG. 5, illustrating similar steps as those illustrated for a two-ply fabric in FIG. 2.
Figure 7:
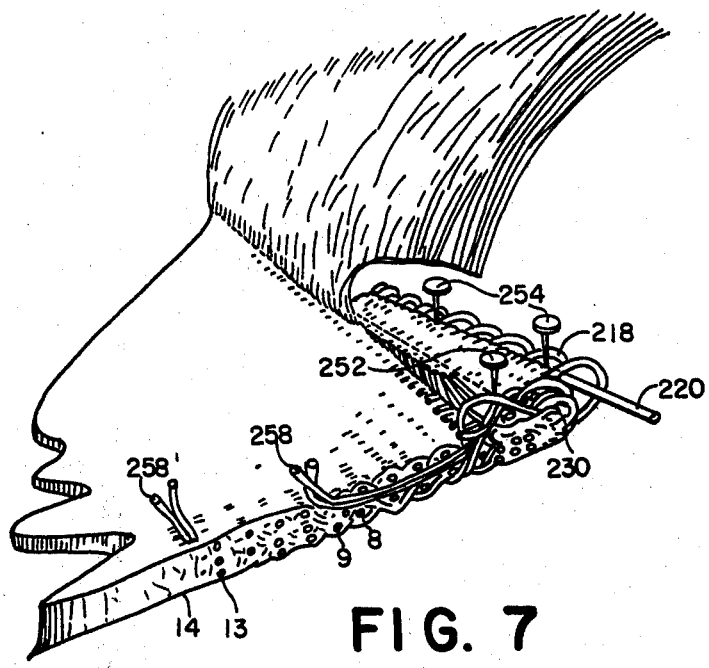
FIG. 7 is a diagrammatic, perspective, fragmentary view of the three-ply fabric end illustrated in FIG. 6 illustrating similar process steps as those illustrated for two-ply fabrics illustrated in FIG. 3.

In order to create appropriate apertures for installing coils, two face, two back and two stuffer picks are removed. Referring to FIG. 5, as illustrated in the enlarged view within the circle designated generally 214 the general orientation of the face, back and stuffer picks is shown. Unlike the two-ply construction described above, it is preferred to remove three back picks starting from the coil area and three back picks on the overlapping region, which are designated 226 and 224 respectively in FIG. 5.

The process may then proceed as described with respect to a two-ply fabric, except that after the curing and folding of the fabric over the overlap region of the fabric may be properly aligned to retain with respect to the fabric body by using hand applied staples preferably installed between the third and fourth pick approximately every five to six inches across the entire width of the fabric. As with the two-ply fabric, it is also a good idea to install tacks in the coil area in the same areas as the previously installed tacks. The three-ply fabric is positioned so that the thirteenth pick of the fabric is lined up with the front end of the work table.

The fill yarn in the fold over fabric is now treated as in the two-ply fabric. However, the crochet needle or weaving needle is now pushed between the layers of fabric under the fourth, fifth, sixth, seventh, and eighth picks with the two adjacent warp yarns being pulled simultaneously through and out of the fabric between the eighth and ninth picks. The needle is then pushed between the layers of the fabric under the fourth, fifth, sixth, seventh, eighth, ninth, tenth, eleventh, twelfth, and thirteenth picks grabbing the two adjacent warp yarns and pulling them simultaneously through and out of the fabric between the thirteenth and fourteenth picks. Again this procedure is alternated across the entire width of the fabric. As with the two-ply fabric, the three-ply fabric is trimmed, treated and processed as with the two-ply fabric.

Figure 8:
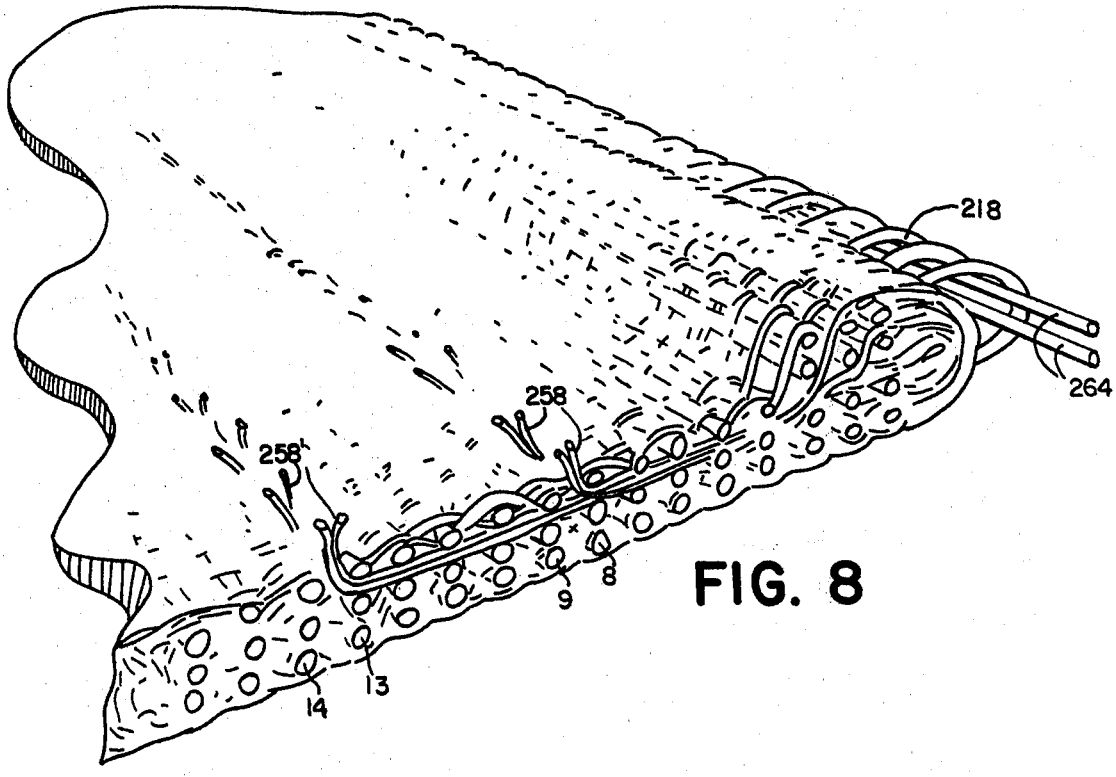
FIG. 8 is a diagrammatic, perspective, fragmentary view of the three-ply fabric end illustrated in FIGS. 5–7, which when trimmed, is complete and represents one half of a complete three-ply fabric seam.

Once the remaining process steps have been completed to produce the finished seam end illustrated in FIG. 8, the seam may be treated and subjected to finishing and resin operations in the same manner as described above with respect to two-ply fabrics and seams created therefrom.

From the above it will be seen that a unique, durable, stitchless low bulk coil-type pin seam is disclosed which combines many of the advantages of sewing overlapping portions of fabric in a coil-type construction, while additionally incorporating reduced bulk in the seam area and a woven-in end to create a smooth transition from the slight additional bulk in the seam area towards the normal thickness in the fabric body.

It will be understood that various changes in the details, materials and arrangement of parts which have been herein described and illustrated in order to explain the nature of this invention may be made by those skilled in the art within the principle and scope of the invention as expressed in the following claims.

What is claimed is:

1. A method of producing a low bulk, stitchless pin-type seam in a multi-ply fabric for use with paper making equipment, comprising the steps of:

(a) providing a length of fabric to be seamed comprising a plurality of longitudinal warp yarns interwoven with at least two ply-forming layers of transverse pick yarns, said layers defining at least front and back plys, said length of fabric being of a length which is longer than the desired seamed fabric length;

(b) removing preselected pick yarns to create apertures in said fabric and define a fold line which corresponds to the fabric end of one of the sides of the seam to be formed, said fold line further defining adjacent fabric body and fabric overlap regions on said fabric;

(c) installing a seaming coil through said apertures;

(d) removing preselected pick yarns from said back ply of said fabric in said fabric body and fabric overlap regions adjacent said coil;

(e) applying a bead of adhesive along said fold line;

(f) folding at least a portion of said overlap region at said fold line to overlap said fabric body region to form a seaming edge defined by said coil;

(g) creating a warp yarn fringe on a portion of said fabric overlap region which is remote to said seam overlap area;

(h) drawing at least portions of said warp yarn fringe between yarns in said fabric body region to complete a first half of said coil seam; and (i) performing at least steps (b) through (h) with respect to a different fabric position whereby a second half of said coil seam is formed to matingly receive said first half to define a pin receiving channel.

2. The invention of claim 1 wherein step (b) further comprises the step of removing a preselected number of said pick yarns from each layer of said fabric to create said apertures.

3. The invention of claim 1 wherein step (a) comprises removing at least 2 pick yarns from each of said ply-forming layers.

4. The invention of claim 1 comprising the additional step of threading a bolt thread between portions of said seaming coil and the back surface of said fabric, before applying the adhesive of step (e).

5. The invention of claim 1 wherein a retaining wire is temporarily threaded between portions of said seaming coil and said front ply of said fabric.

6. The invention of claim 1 wherein step (d) further comprises removing at least 3 of said pick yarns in each of said fabric body and fabric overlap regions.

7. The invention of claim 6 wherein said pick yarns to be removed are those which are most adjacent to said seaming coil within said back ply of said fabric in said fabric body and fabric overlap regions.

8. The invention of claim 1 wherein step (d) further comprises removing at least 5 of said pick yarns in each of said fabric body and fabric overlap regions.

9. The invention of claim 8 wherein said pick yarns to be removed are those which are most adjacent to said seaming coil within said back ply of said fabric in said fabric body and fabric overlap regions.

10. The invention of claim 1 wherein step (c) further comprises the step of threading at least a portion of said seaming coil ends back between the back surface of said fabric and within other portions of said seaming coil.

11. The invention of claim 10 comprising the additional step of threading a bolt thread between said back surface of said fabric and portions of the loops of said seaming coil, portions of said bolt thread overlapping at least portions of said seaming coil.

12. The invention of claim 1 further comprising the step of stapling said overlapping regions to each other following the performance of step (f).

13. The invention of claim 12 wherein said staples are spaced by 2–3 inches across said fabric width.

14. The invention of claim 13 wherein said staples are applied between the third and fourth picks away from said fold line.

15. The invention of claim 13 wherein said staples are applied between the second and third picks away from said fold line.

16. The invention of claim 1 wherein step (g) further comprises the step of tacking the fabric end face down to a work surface prior to creating said warp yarn fringe.

17. The invention of claim 1 wherein step (g) further comprises the step of cutting a preselected number of back warp yarns along a preselected transverse axis.

18. The invention of claim 17 wherein said step of creating said warp yarn fringe comprises the steps of removing pick yarns in the vicinity where said fringe is to be formed, and unraveling said warp yarns to create said fringe.

19. The invention of claim 1 wherein step (h) comprises drawing a plurality of the yarns of said warp yarn fringe along the same path between yarns in said fabric body region.

20. The invention of claim 19 wherein step (h) comprises the drawing of at least 2 warp yarn fringe yarns along the same path within said fabric body region.

21. The invention of claim 1 comprising the additional step of resin treating at least a portion of said seam to improve at least the dimension stability of said seaming coils.

22. The product produced in accordance with the method of claim 1.

* * * * *